US007748087B2

(12) United States Patent
Dubois et al.

(10) Patent No.: US 7,748,087 B2
(45) Date of Patent: Jul. 6, 2010

(54) UNFOLDING CLASP FOR WRIST BAND

(75) Inventors: Antoine Dubois, Villiers-le-Lac (FR); Laurent Taton, Hong Kong (CN)

(73) Assignee: LVMH Swiss Manufactures SA, La Chaux-de Fonds (CH)

( * ) Notice: Subject to any disclaimer, the term of this patent is extended or adjusted under 35 U.S.C. 154(b) by 8 days.

(21) Appl. No.: 11/781,296

(22) Filed: Jul. 23, 2007

(65) Prior Publication Data

US 2007/0283537 A1 Dec. 13, 2007

Related U.S. Application Data

(63) Continuation of application No. PCT/EP2006/050323, filed on Jan. 20, 2006.

(30) Foreign Application Priority Data

Jan. 25, 2005 (CH) ..... 0113/05

(51) Int. Cl.
*A44C 5/24* (2006.01)

(52) U.S. Cl. ..... 24/71 J; 24/265 WS

(58) Field of Classification Search ..... 24/265 W, 24/71 R, 71 ST, 70 J, 69 J, 71 J, 68 J
See application file for complete search history.

(56) References Cited

U.S. PATENT DOCUMENTS

| | | | | |
|---|---|---|---|---|
| 1,689,640 | A | 10/1928 | Newman | |
| 6,449,809 | B2 * | 9/2002 | Thalheim | 24/71 J |
| 2004/0168469 | A1 * | 9/2004 | Tetu et al. | 63/3.1 |

FOREIGN PATENT DOCUMENTS

| | | | |
|---|---|---|---|
| CH | 665101 | | 4/1988 |
| CH | 668353 | | 12/1988 |
| CH | 684151 | A5 * | 7/1994 |
| EP | 63166 | A1 * | 10/1982 |
| EP | 914781 | A1 | 5/1999 |
| EP | 1247469 | B1 | 6/2005 |
| GB | 2273736 | A | 6/1994 |
| JP | 09000320 | A * | 1/1997 |
| WO | WO 9422340 | A1 * | 10/1994 |
| WO | 03/022090 | A1 | 3/2003 |

OTHER PUBLICATIONS

International Search Report for Application No. PCT/EP2006/050323, Date: Apr. 5, 2006.

* cited by examiner

*Primary Examiner*—James R Brittain
(74) *Attorney, Agent, or Firm*—Pearne & Gordon LLP

(57) ABSTRACT

Clasp with unfolding buckle for wristlet, having: an inside blade (3), two outside blades (1) forming an articulated shank with the inside blade, two push-pieces (7) capable of being actuated transversely against the action of an elastic element (9) for unlocking the clasp, at least one stopping (11) connected removably to said push-piece (7) for limiting the amplitude of displacement of said push-piece along at least one axis.

16 Claims, 4 Drawing Sheets

UNFOLDING CLASP FOR WRIST BAND

REFERENCE DATA

This application is a continuation of International Patent Application PCT/EP2006/050323 (WO2006/079605) filed on Jan. 20, 2006 under priority from Swiss patent application 2005CH-00113 of Jan. 25, 2005, the contents of which are hereby incorporated by reference.

TECHNICAL FIELD

The present invention concerns a clasp with unfolding buckle for wristlet, in particular a clasp with unfolding buckle for watch bracelet.

STATE OF THE ART

WO03/022090, in the applicant's name, describes a clasp with unfolding buckle having two push-pieces that can be actuated by moving them in opposite sense against the action of two spring bars. The guiding of the push-pieces is ensured by the external walls of a cover and by the rods engaged in blind holes in both push-pieces. In order to exclude a displacement of the push-pieces along a non-transverse direction, which could cause the device to grip, it is necessary to machine the transverse walls of the cover with strict tolerances. Furthermore, the thickness of these walls must be considerable in order to ensure an accurate guiding. This solution, though reliable, is thus expensive. Furthermore, assembling the clasp is a delicate operation and requires a casing to be screwed onto the cover.

EP 1247469 describes another clasp with unfolding buckle having two push-pieces. Two spring rods are necessary for moving the two push-pieces apart from one another and to ensure a perfectly parallel displacement. The size of the push-pieces is thus necessarily considerable and the cost increased by having two spring rods. Furthermore, the push-pieces of this construction are held back by the two central blades only when the clasp is locked. The buttons risk however becoming disunited from the clasp when the latter is open.

EP914781 describes another clasp construction having two push-pieces that can be actuated along opposite directions. The pieces are pushed back against the lateral walls of a cover thanks to a compressed spring. The clasp risks becoming disassembled if the user presses simultaneously on both pieces with sufficient force.

CH665101 describes a wristlet clasp having push-pieces that bank one against the other to limit their displacement. The push-pieces thus take up a considerable volume at the centre of the clasp and the stopping of the push-pieces is clean only when both push-pieces are guided correctly when they are displaced.

GB2273736 describes a wristlet clasp having two push-pieces whose amplitude of movement is limited by stoppings. These stoppings are not removable and are not connected to the push-piece. The assembly is complicated and the clasp requires a large number of distinct parts to insert the push-pieces over the stoppings.

CH668353 describes another example of clasp with two push-pieces. The push-pieces can be inserted easily, despite the stoppings, since they are only loosely guided into the clasp; there are however not satisfactorily held, especially when the clasp is open.

AIMS OF THE INVENTION

One aim of the present invention is to propose an improved clasp with unfolding buckle, in particular a clasp that allows at least certain of the mentioned problems to be solved.

In particular, one aim of the present invention is to propose a clasp with unfolding buckle that is more economical, more reliable and/or easier to assemble than the known clasps.

These aims are notably achieved by means of a clasp having the claimed elements, in particular by means of a clasp with unfolding buckle for wristlet, having:

a first blade, at least a second blade articulated with said first blade, at least one push-piece that can be actuated against the action of an elastic element for unlocking said clasp, at least one stopping for limiting the amplitude of displacement of said push-piece along at least one axis, said stopping being connected removably with said push-piece.

This solution has notably the advantage of making the clasp's assembly easier. In fact, before the stopping is assembled, the push-piece can preferably be moved freely along said axis, which allows it to be inserted easily into the clasp. The assembly is finished by connecting the stopping or stoppings to the push-piece or push-pieces, which allows their displacement to be limited and to prevent notably that they become disassembled or disunited from the clasp.

In a preferred embodiment of the invention, it becomes impossible to disassemble the push-pieces when the stoppings are connected to the push-pieces and becomes easy when this removable connection is interrupted.

The stoppings allow for example:

in locked position, to limit the amplitude of displacement of said clasp both along a transverse axis and long a vertical axis, and in unlocked position, to limit the amplitude of displacement of said clasp along a transverse axis only.

In this text, the transverse axis refers to the wristlet. The push-pieces are actuated by a translation movement along this transverse axis, and the stoppings allow the displacement in at least one direction, preferably in both directions, to be limited, which make it notably possible to avoid the risk of both push-pieces coming completely out of the clasp. The vertical axis is perpendicular to the plane of the wristlet's ends; the clasp is opened by lifting its cover along one direction having at least one vertical component. The locking of the stopping's vertical displacements thus allows the clasp to be locked.

BRIEF DESCRIPTION OF THE DRAWINGS

The present invention will be better understood by reading the description given by way of example and illustrated by the attached figures in which.

EMBODIMENT(S) OF THE INVENTION

Figure 1:
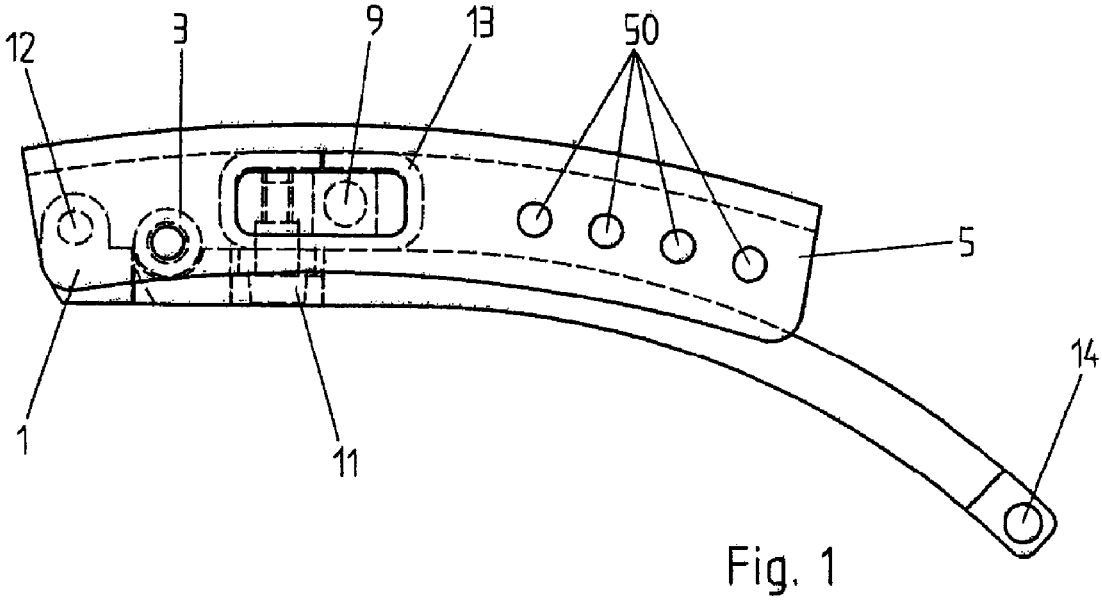
FIG. 1 is a side view of the inventive clasp in locked position.
Figure 2:
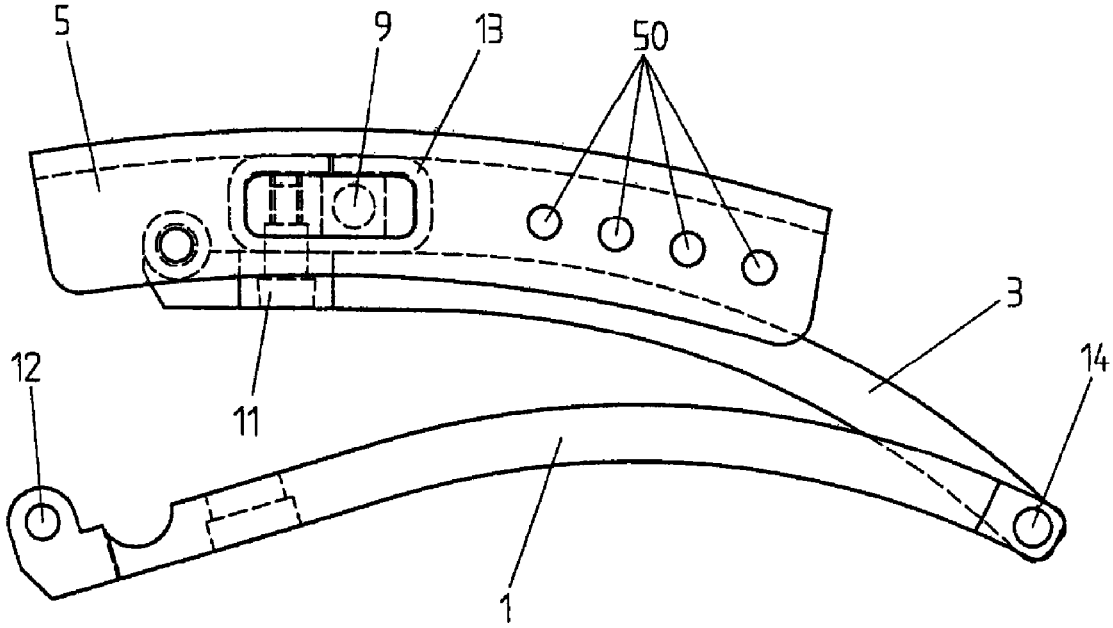
FIG. 2 is a side view of the inventive clasp in open position.
Figure 3:
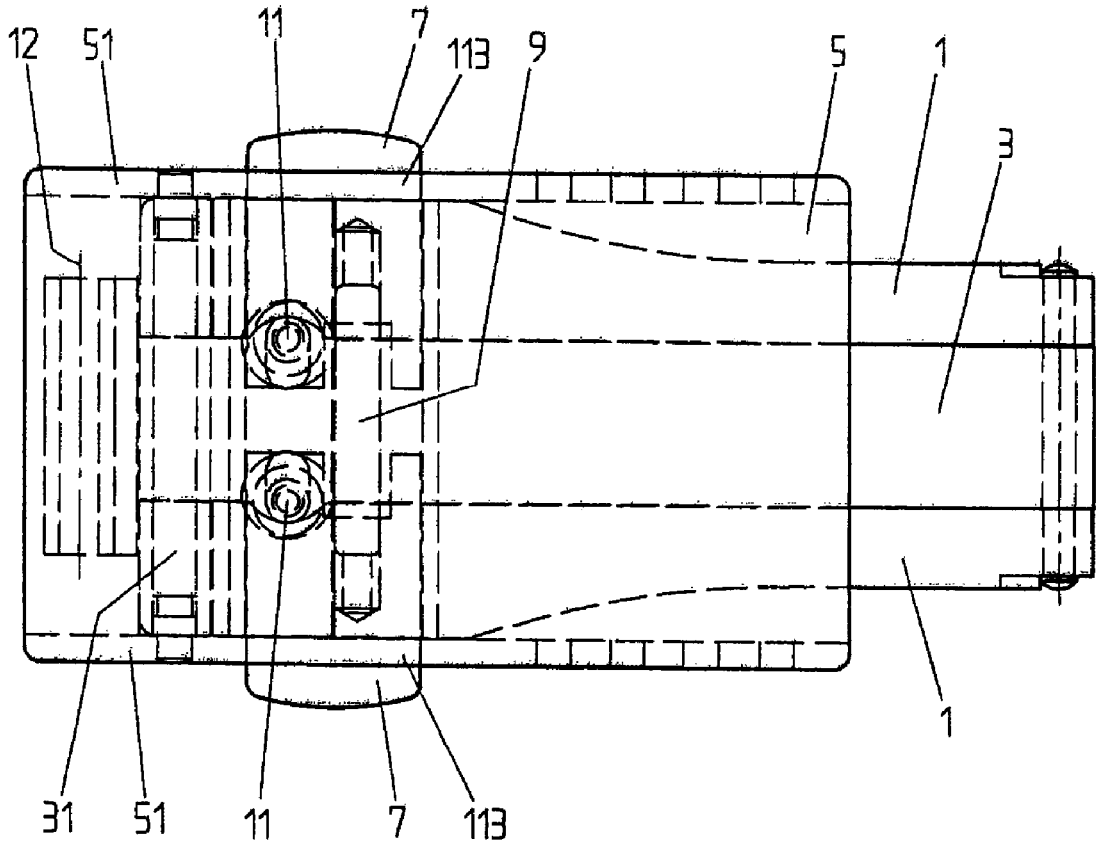
FIG. 3 is a top view of the inventive clasp in locked position.
Figure 4:
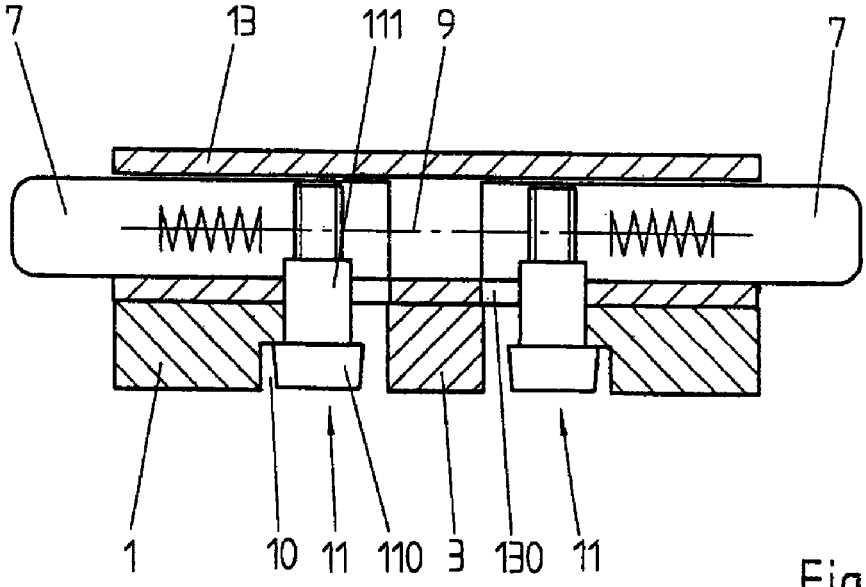
FIG. 4 is a partial longitudinal cross section of the inventive clasp in locked position, showing the push-pieces with their stopping, mounted inside their guiding element, as well as the second blade.

The clasp illustrated in the figures is designed to be used with supple wristlets, for example leather or rubber wristlets, or with bracelets formed of rows of metallic links. It includes a first inside blade 3 that folds back between two second outside blades 1. In folded position, the blades 1 and 3 thus take up a single width. The two blades 1 and 3 are articulated with one another by means of a pin going through a hole 14 at one end of the two blades.

The first inside blade 3 is connected in an articulated manner with a clasp cover 5, by means of a pin or a spring bar going through a hole 31 and lodged in blind holes in the cover's lateral walls. A first end of the wristlet (not illustrated) is connected with the other end of the cover 5; in the illustrated example, several holes or blind holes 50 are provided in the lateral walls of the cover 5 in order to allow a fine adjusting of the wristlet's length by modifying its fastening point on the cover 5.

The second outside blades 1 are articulated at their other end with a second end of the wristlet (not illustrated) connected with the blades 1 by a pin going through a hole 12.

The metallic cover 5 has at least three orthogonal sides defining a volume that allows the locking mechanism to be hidden and protected. Each of the two lateral sides is provided with an opening 113 through which one of the two push-pieces 7 goes.

The clasp illustrated in the figures has two blades 1 and 3, so that its length can be approximately doubled when unfolded. The inventive clasp applies however also to other types of unfolding buckles, including Z buckles, butterfly buckles, etc.

Figure 5:
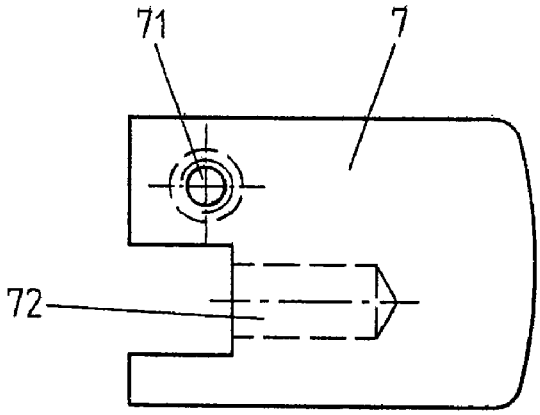
FIG. 5 is a top view of a push-piece of the inventive clasp.

The inventive clasp has two push-pieces 7 protruding outside the lateral walls of the cover 5. The clasp can be unlocked by pressing the two push-pieces simultaneously, in a transverse direction. An elastic element 9 engaged in blind holes 72 (FIG. 5) on the inside sides of the two push-pieces 7 allows these two organs to be pushed back and the clasp to be kept locked when no outside force is exerted. In the illustrated example, the elastic element 9 is constituted by a single spring bar, constituted by cased-up two telescopic tubes and a helical spring compressed inside the tubes. It is also possible, within the frame of the invention, to use a solid pin and a spring at the end of this pin, or at each of the two ends of the pin. Furthermore, in the case of a clasp of larger size, a more accurate guiding can be achieved by using two pins or spring bars in parallel to push back the two push-pieces.

Figure 6B:
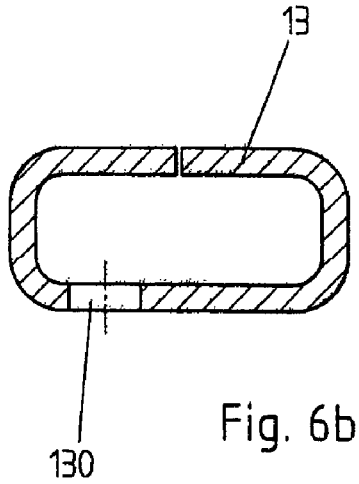
FIG. 6A resp. 6B show a top view, resp. a lateral cross-section, of the guiding element of the inventive clasp.
Figure 6A:
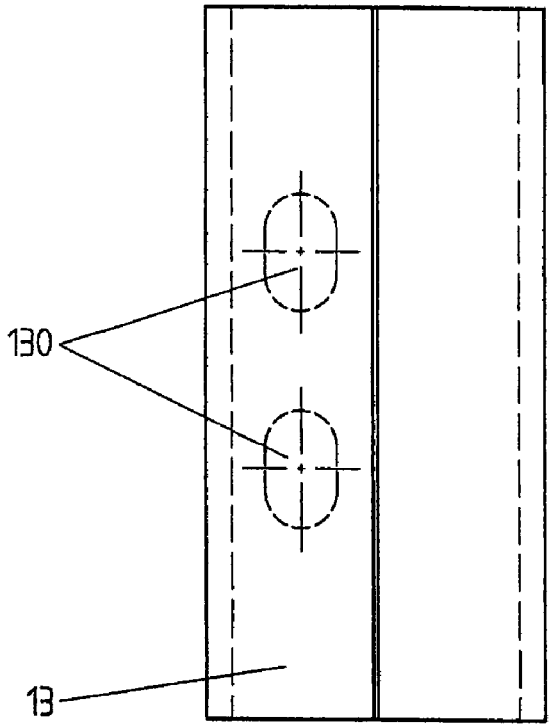
Figure 7A:
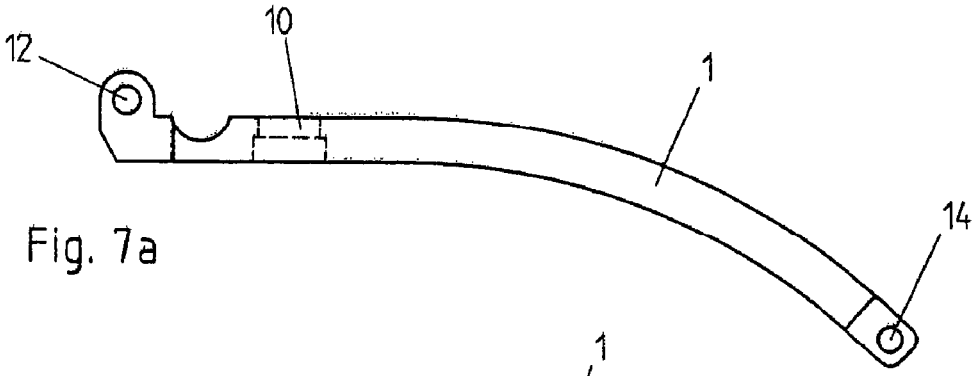
FIG. 7*a* resp. 7*b* are side resp. top views of the second unfolding blades of the inventive clasp.
Figure 7B:
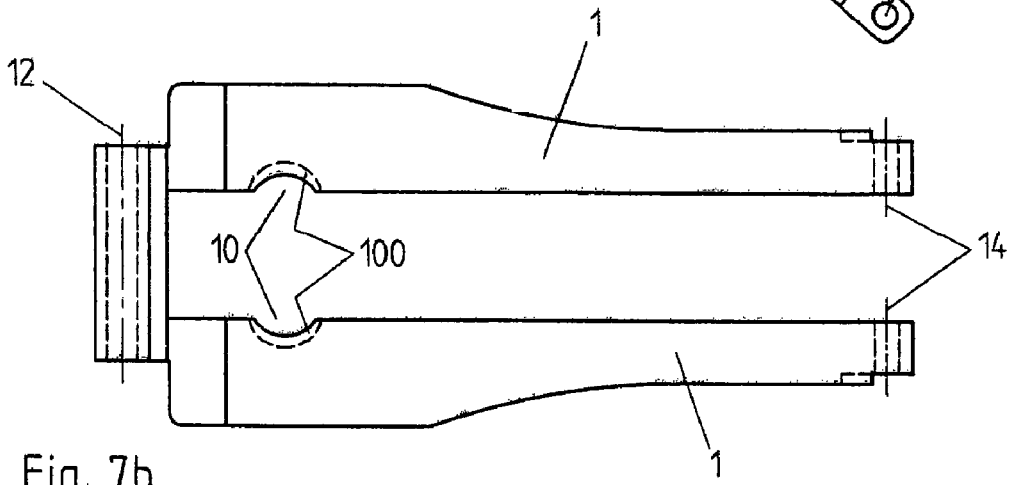
Figure 8A:
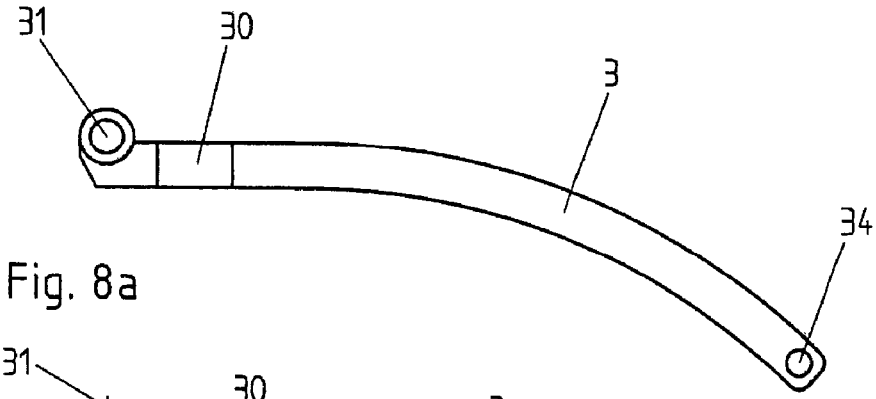
FIG. 8*a* resp. 8*b* are side resp. top views of the first unfolding blades of the inventive clasp.
Figure 8B:
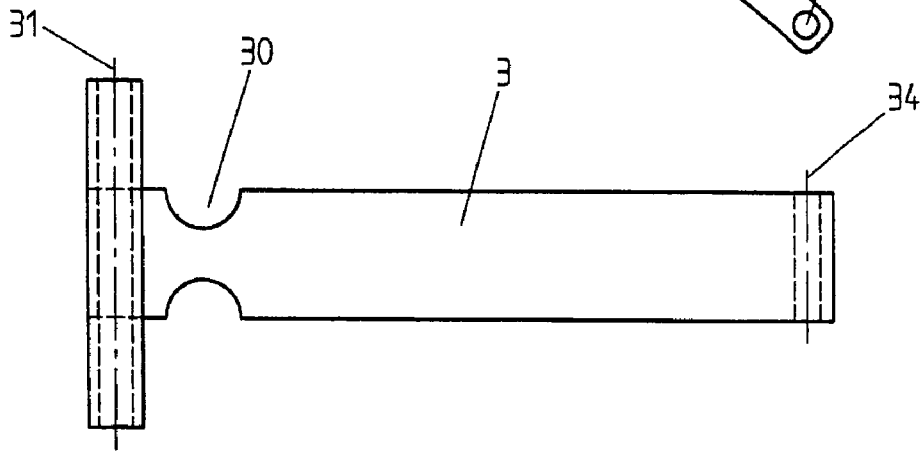

The inventive clasp further includes a guiding element 13 illustrated in particular in FIGS. 6A and 6B for holding the two push-pieces and guiding them during their displacements. The guiding element 13 is constituted by a hollow tube whose shape and dimensions of the inside window correspond to the shapes and external dimensions of the push-pieces. It is held against the two inside sides of the lateral walls of the cover 5, onto which it can be welded, clipped or held by other suitable means. In a variant embodiment, not illustrated, the guiding element 13 could be an integral part of the cover with which it could even be machined. The illustrated guiding element has however the advantage of being capable of being manufactured economically, with accurate tolerances, by folding and drilling of a flat sheet.

The clasp further has two stoppings 11 to limit the displacement of the push-pieces. The stoppings 11 are connected removably to the corresponding push-pieces 7. In the illustrated example, each stopping 11 has one head 110 and one shaft 111. The shaft of each stopping 111 is screwed into a hole 71 in each of the two push-pieces. The head of the stopping 111 can be split so as to allow screwing by means of a screwdriver. In a preferred embodiment, one portion of the shaft of the stopping 11 protruding from the push-piece 7 is provided with an unevenness or a polygonal rim allowing it to be screwed or unscrewed by means of a wrench; this embodiment has the advantage of hiding the screw slit and to limit the risk of a user unscrewing the stoppings accidentally. A drop of glue or other means allowing the unscrewing to be made more difficult can also be used.

The stoppings 11 could also be connected to the corresponding push-pieces by other means, for example gluing, clipping, etc.

The stoppings 11 move transversely in a plane parallel to the wristlet with the push-pieces 7 when the latter are actuated or released. For this purpose, two oblong windows 130 are provided in the guiding element 13 parallel to the latter's axis; the stoppings traverse these windows that guide their displacement. The amplitude of transverse displacement of each of the two stoppings is limited by the contact with the two rims of the corresponding window.

In a variant embodiment, only the amplitude of displacement imposed by the bar is limited by the windows 130 whilst the direct contact of the two push-pieces to one another or the contact of the bar 9 or with other elements of the clasp, allows the amplitude of displacement in the opposite sense to be limited when the user presses on the push-pieces.

In another variant embodiment, a single oblong window oriented parallel to the axis of the guiding element is provided in the lateral side of said guiding element, the transverse displacement of each stopping, when the push-pieces are pushed back by the elastic element, is limited by the side of each extremity of the single window.

In locked position, the shaft of the stoppings 11 goes through openings 10 resp. 30 in the blades 1 resp. 3. The head 110 of the stoppings 11, whose diameter is greater than that of that of the shaft, is held under the blades 1 and 3 by a contact portion 100 constituted in this example by an unevenness in the half-circle opening 10 through the second outside blades 1. The heads of the stoppings 11 cooperate with said outside blades, thus locking the blades 1 and 3 to prevent the vertical displacement of the cover 5 and the clasp's opening in locked position.

In unlocked position, when the user presses on the push-pieces 7, the stoppings move in the direction of the central axis of the blades 1, 3 until the head of the stoppings 11 disengage from the contact portion 100 and arrive opposite the half-circle openings 30 whose greater diameter allows the heads to pass. In this position, the clasp can be opened by lifting the cover 5 and the first inside blade 3 by a rotation movement around the axis 34. In a variant embodiment, a spring can be provided to ensure an automatic opening of the clasp when the push-pieces are sufficiently pressed in.

In the illustrated clasp, the stoppings traverse the openings 10, 30 through the two blades 1 and 3. This solution allows optimum access to the openings 10, 30 when the wristlet is open and makes it easier to clean this sensitive zone. In the frame of the invention, it is also possible for each of the stoppings to move in oblong windows through one only of the blades 1 or 3, for example through the outside blade 1.

The stoppings' head preferably comes just close to the lower side of the blades 1 and 3 in folded position. In order to avoid any risk of the user being injured, the stoppings' heads as well as the windows 10, 30 in which they move preferably have a rather non-aggressive shape, without sharp angles. In a variant embodiment, not illustrated, the stoppings 11 lock onto a locking portion provided on the upper side of the blades 1 and/or 3, that can then remain without through openings.

The inventive clasp is assembled by inserting, from the outside, the two push-pieces 7 through the corresponding openings in the lateral walls of the cover 5; the bar 9 is previously positioned in the guiding element 13 so as to lodge in the blind holes 72 of the push-pieces 7 whose insertion it guides. The push-pieces 7 are then sufficiently pressed in each in its turn, against the force exerted by the spring bar 9, until the holes 71 arrive opposite the openings 130 in the guiding element 13. The stoppings 11 can then be screwed in the blind holes, through the windows 130, and by means of a wrench or any other tool, not illustrated.

LIST OF REFERENCES

1 Second outside blade (shank)
10 Opening in the outside blade
100 Contact position in the outside blade
11 Mobile stopping
110 Stopping head
111 Stopping shaft
113 Opening in a lateral wall of the cover for the passing of a push-piece
12 Through hole for the outside blade to wristlet pin
13 Guiding element of the push-pieces
130 Windows in the guiding element of the push-pieces
14 Through hole for the inside blades-outside blades articulating pin
3 First inside blade
30 Passage of stopping in inside blade
34 Through hole for the inside blades-outside blades articulating pin
31 Through hole for the pin for fastening the cover
5 Cover
50 Fastening holes of the wristlet
51 Lateral walls of the cover
7 Push-piece
71 Fastening hole male stopping in push-piece
72 Guiding hole of bar in push-piece
9 Spring bar

The invention claimed is:

1. Clasp with unfolding buckle for wristlet, having:
a first blade,
at least a second blade articulated with said first blade,
at least one push-piece that can be actuated against the action of an elastic element for unlocking said clasp,
at least one stopping for limiting the amplitude of displacement of said push-piece along at least one axis, and
a guiding tube for guiding said push-piece when the push-piece is actuated, said elastic element being compressed so as to push the push-piece back, at least one window in said guiding tube, said stopping moving in said at least one window,
wherein said stopping is connected removably with said push-piece and cooperates with said second blade to lock said clasp in locked position.

2. The clasp of claim 1, wherein said stopping allows the amplitude of displacement imposed by said elastic element to said push-piece along a transverse axis to be limited.

3. The clasp of claim 1, wherein said stopping allows, in locked position, said clasp to be held locked by limiting the possible amplitude of displacement of said push-piece along a vertical axis.

4. The clasp of claim 3, said stopping being held by a portion of said second blade in locked position, and traversing said first blade during unlocking.

5. The clasp of claim 1, wherein said stopping allows: in locked position, to limit the amplitude of displacement of said push-piece both along a transverse axis and along a vertical axis, and in unlocked position, to limit the amplitude of displacement of said push-piece along a transverse axis only.

6. The clasp of claim 1, having: two said push-pieces, one said stopping connected to each said push-piece, one said guiding tube of said two push-pieces for guiding said two push-pieces when they are actuated, said elastic element being compressed between said push-pieces so as to push them back along a transverse direction, said stoppings moving in said at least one window.

7. The clasp of claim 6, wherein the amplitude of said transverse displacement of the stopping is limited by the contact of said stopping against a rim of said window.

8. The clasp of claim 6, said window allowing said stoppings to be guided when said push-pieces are actuated.

9. The clasp of claim 1, said stopping being connected with said push-piece through a screw connection.

10. The clasp of claim 1, further having a cover, one extremity of said first blade being articulated with said cover, one extremity of said second blade being articulated with a second end of the wristlet, said cover being connected with a first end of the wristlet.

11. The clasp of claim 10, said cover having two lateral walls provided with openings traversed by said push-piece or push-pieces.

12. The clasp of claim 1, said elastic element being constituted by an extensible spring bar compressed between said push-pieces.

13. The clasp of claim 1, having two said second blades, said first blade lodging in folded position between said two second blades.

14. The clasp of claim 1, wherein said stopping includes a shaft and a head, said shaft is screwed in said push-piece, and said second blade is locked between said clasp and said head in locked position.

15. Clasp with unfolding buckle for wristlet, having:
a first blade,
at least a second blade articulated with said first blade,
at least one push-piece that can be actuated against the action of an elastic element for unlocking said clasp, said push-piece located on the first blade, and
at least one stopping for limiting the amplitude of displacement of said push-piece along at least one axis, said stopping for engaging and locking the second blade,
wherein said stopping is connected removably with said push-piece and said stopping travels with said push-piece as one.

16. Clasp with unfolding buckle for wristlet, having:
a first blade,
at least a second blade articulated with said first blade,
two push pieces that can be actuated against the action of an elastic element for unlocking said clasp,
one stopping connected with each push-piece, and
a tube for holding and guiding said two push-pieces, two separate windows in the tube,
wherein each stopping traverses one window, said elastic element being compressed between said push-pieces as to push said push-pieces back along a transversal direction, said stoppings moving in said windows together with said push-pieces in said transversal direction; and said stoppings limiting the amplitude of displacement of said push-pieces along said transversal direction.

* * * * *

UNITED STATES PATENT AND TRADEMARK OFFICE

CERTIFICATE OF CORRECTION

PATENT NO. : 7,748,087 B2
APPLICATION NO. : 11/781296
DATED : July 6, 2010
INVENTOR(S) : Antoine Dubois et al.

It is certified that error appears in the above-identified patent and that said Letters Patent is hereby corrected as shown below:

Column 3, Line 58: please delete "111" (second occurrence) and replace with "11"
Column 3, Line 60: please delete "111" and replace with "11"

Signed and Sealed this

Twenty-first Day of September, 2010

David J. Kappos

David J. Kappos
*Director of the United States Patent and Trademark Office*